US008028690B1

(12) United States Patent
Lohaus

(10) Patent No.: US 8,028,690 B1
(45) Date of Patent: Oct. 4, 2011

(54) FIRE PIT

(76) Inventor: Jeffrey Lohaus, Minneapolis, MN (US)

( * ) Notice: Subject to any disclaimer, the term of this patent is extended or adjusted under 35 U.S.C. 154(b) by 617 days.

(21) Appl. No.: 11/897,810

(22) Filed: Aug. 31, 2007

(51) Int. Cl.
*F24B 1/18* (2006.01)

(52) U.S. Cl. ..... 126/519; 126/12; 126/13; 126/65

(58) Field of Classification Search ..... 126/519, 126/12, 13, 59, 58, 65, 102
See application file for complete search history.

(56) References Cited

U.S. PATENT DOCUMENTS 21,938 A * 11/1858 Buchanan ..... 126/519
2003/0029443 A1 * 2/2003 Davis et al. ..... 126/543
* cited by examiner

*Primary Examiner* — Alfred Basichas
(74) *Attorney, Agent, or Firm* — Hall Estill Law Firm

(57) ABSTRACT

A fire pit comprising a base assembly, the base assembly supported by a suspension assembly comprising a plurality of vertical supports, and a tower assembly disposed on a top surface of the base assembly, the tower assembly comprising a plurality of longitudinal apertures and configured to contain at least one solid fuel source. The plurality of longitudinal apertures are configured to release heat generated from the at least one solid fuel source in a substantially outward direction along at least substantially the entire length of the plurality of longitudinal apertures.

13 Claims, 6 Drawing Sheets

FIRE PIT

FIELD OF THE INVENTION

This invention relates generally to heating and cooking apparatuses, and more particularly to a fire pit.

BACKGROUND

Fire pits or fireplaces are popular in backyard patios as well as in national forests, state parks, private parks, campgrounds, beaches, and the like. Fire pits are utilized for a variety of purposes, including providing heat and preparation of food.

It is therefore one object of the present invention to provide a visually attractive fire pit for heating and cooking purposes.

SUMMARY

Accordingly, various embodiments of the fire pit comprise a base assembly and a tower assembly. The base assembly is supported by a support assembly comprising a plurality of vertical supports disposed on a bottom surface of the base assembly. The tower assembly comprises a plurality of longitudinal apertures and is configured to contain at least one solid fuel source. The plurality of longitudinal apertures are configured to release heat generated from the at least one solid fuel source in a substantially outward direction along substantially the entire length of the plurality of longitudinal apertures.

BRIEF DESCRIPTION OF THE DRAWINGS

Objects, features, and advantages of the fire pit will become more apparent from the following detailed description of the various embodiments when taken together with the accompanying drawings in which.

DETAILED DESCRIPTION

Figure 1:
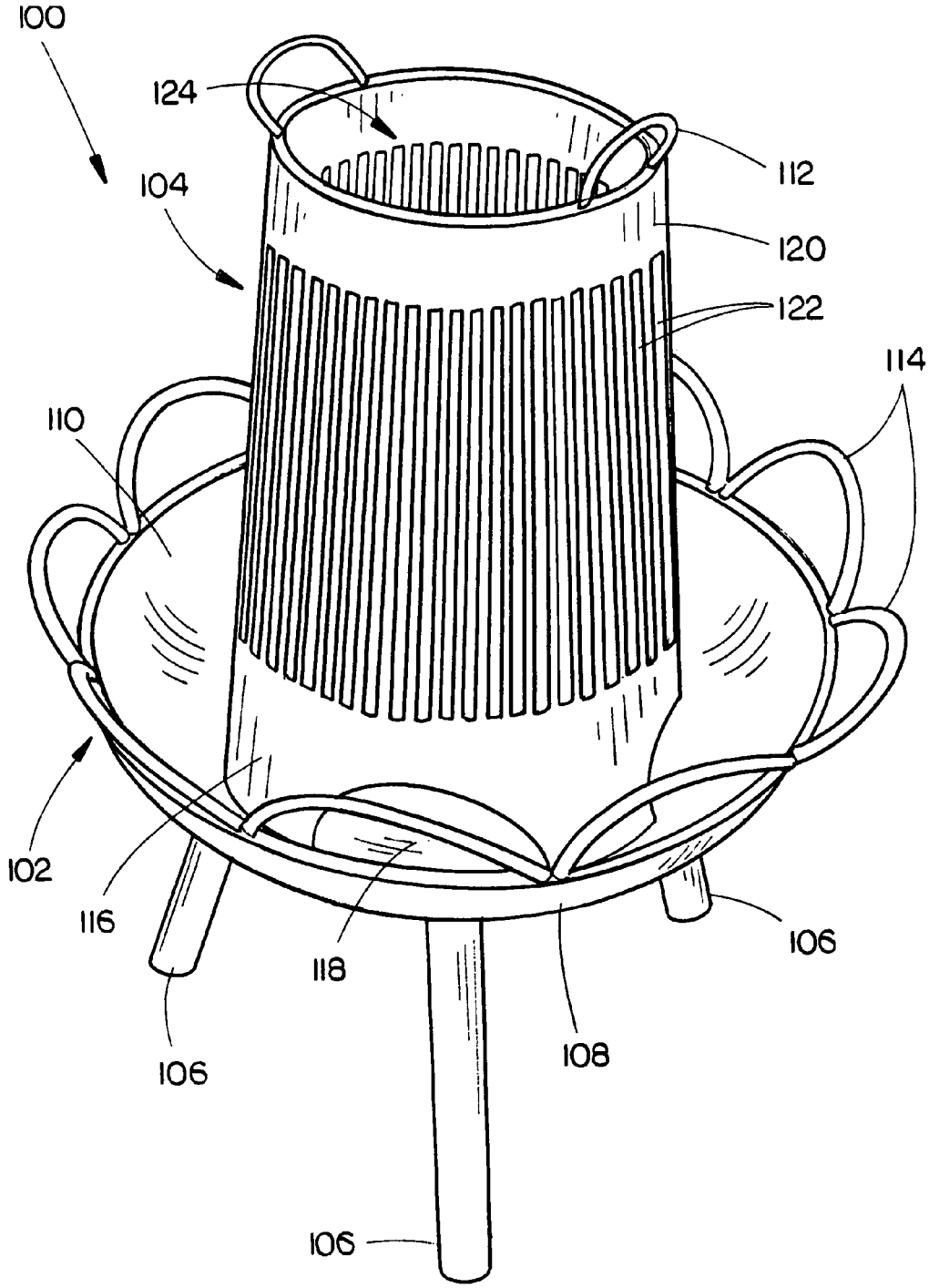
FIG. 1 is an isometric view of an assembled fire pit according to the various exemplary embodiments of the present invention.
Figure 2:
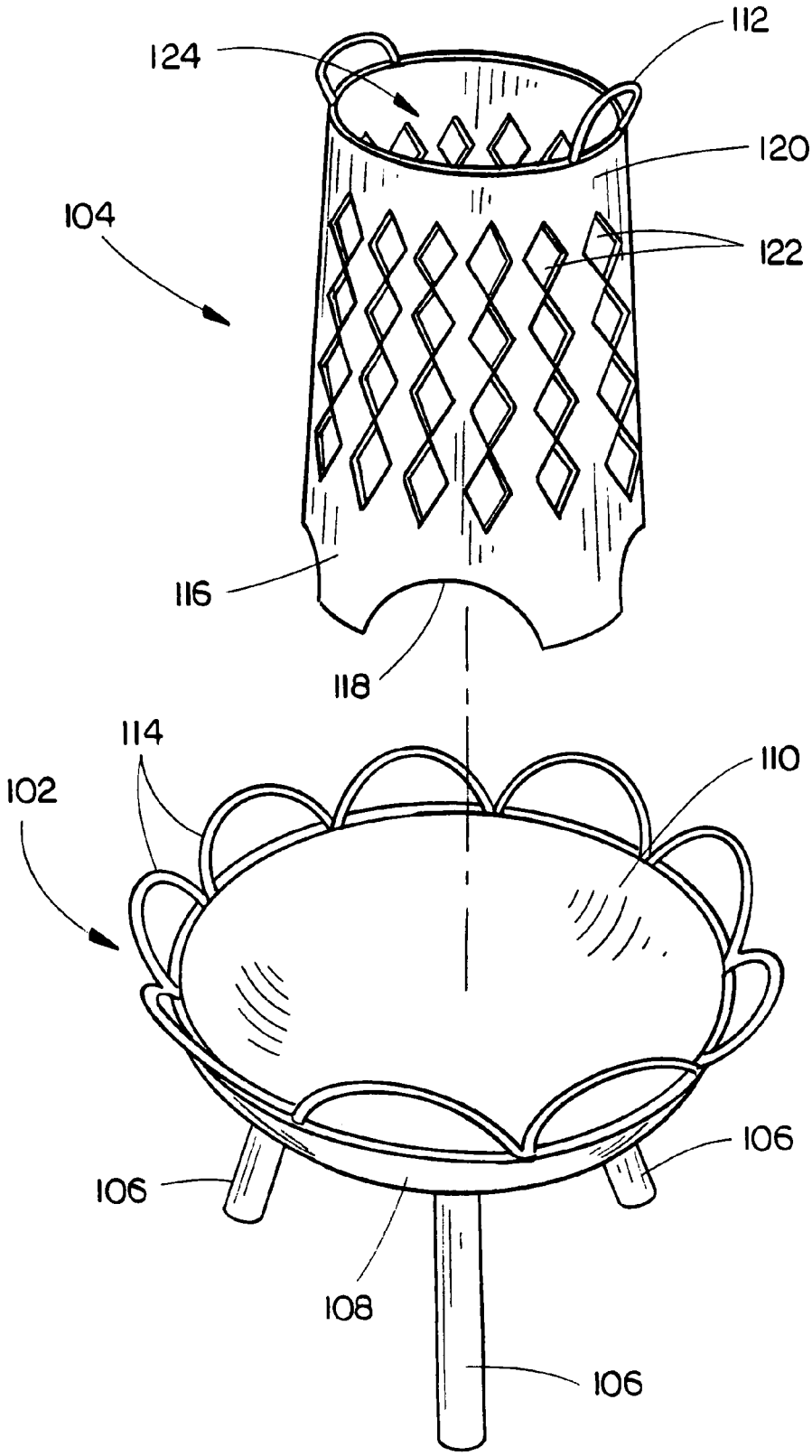
FIG. 2 is an isometric view of the fire pit components according to the various exemplary embodiments of the present invention.
Figure 3:
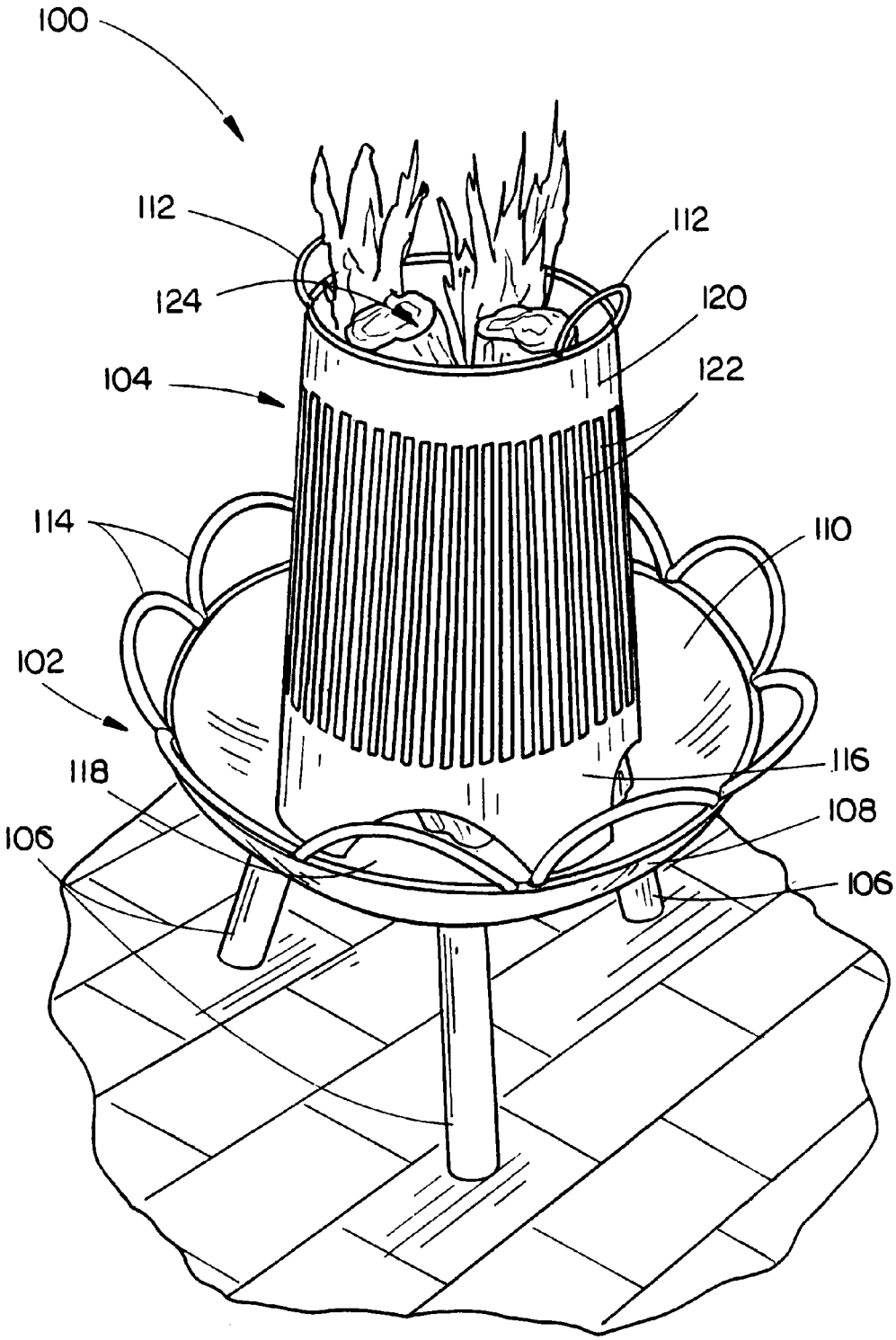
FIG. 3 is an isometric view of the fire pit burning a fuel source according to the various exemplary embodiments of the present invention.
Figure 4:
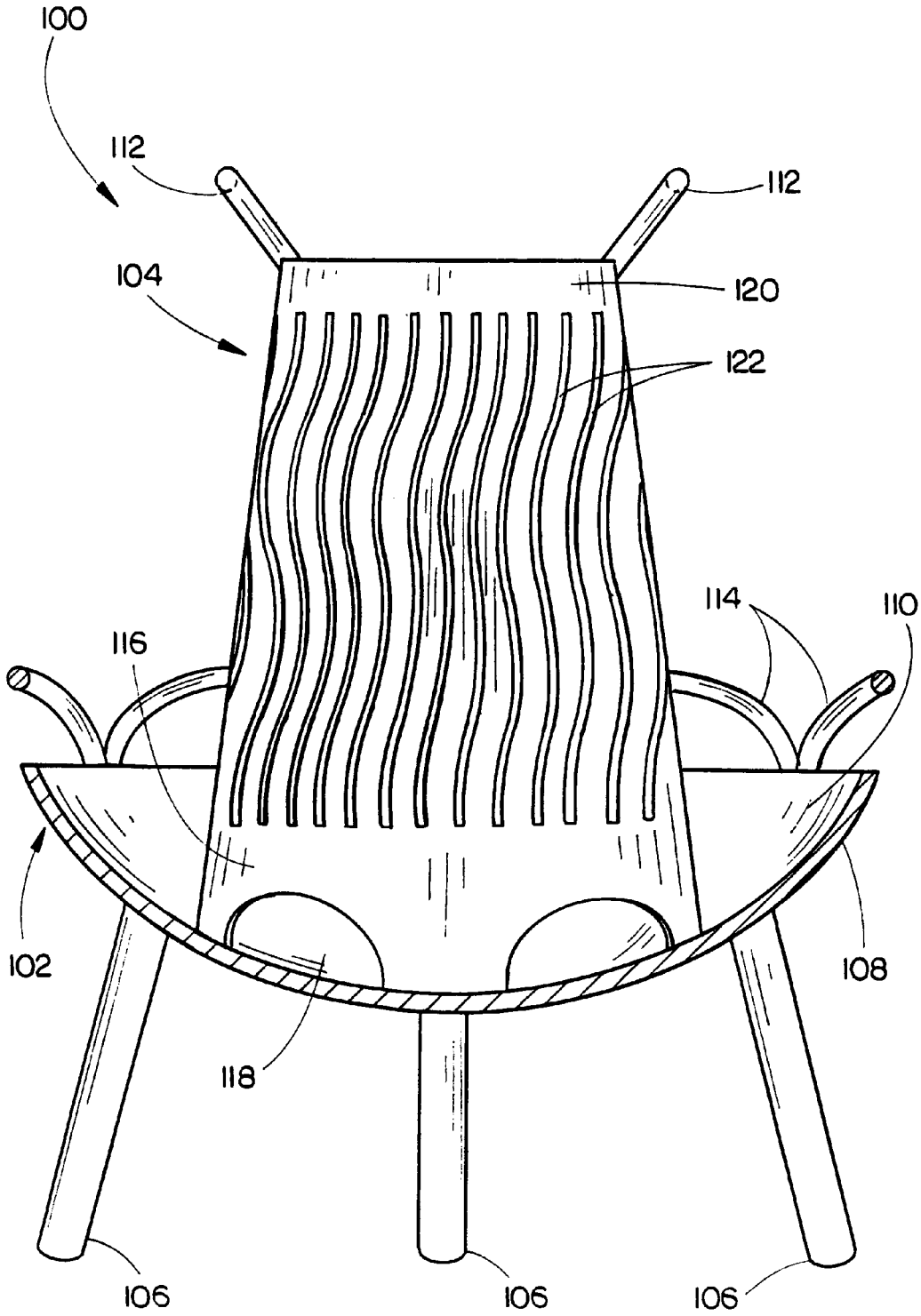
FIG. 4 is a side view of the fire pit according to the various exemplary embodiments of the present invention.

Referring generally to FIGS. 1-4, various views of the fire pit 100 are shown. FIG. 103 are isometric illustrations of the fire pit 100. FIG. 4 is a side view of the fire pit 100. Fire pit 100 is suitable for burning wood logs or like wood pieces of the type and size used in home fireplaces and outdoor campfires, coal, or like burning fuel sources. Fire pit 100 comprises a base assembly 102 and a tower assembly 104 suitable for coupling to the base assembly 102. The base assembly 102 and tower assembly 104 are configured to be integrated to form a single fire pit 100. It is also contemplated that either the base assembly 102 or the tower assembly 104 may be utilized separately, or multiple tower assemblies 104 may be utilized interchangeably or simultaneously with a single base assembly 102 if desired.

In a preferred embodiment, the base assembly 102 is a substantially concave or semi-ellipsoidal dish. Base assembly may be any shape, including, but not limited to, substantially circular, rectangular, triangular, semi-circular, square or trapezoid, or may be any pattern or design, including a custom design in accordance with the desires of a user 1. Regardless of shape, pattern or design, the base assembly 102 may comprise a central region that is substantially lower with respect to the vertical axis than the region substantially surrounding the central region, and the edges of the base assembly 102 may be formed having the highest vertical distance from a surface upon which the base assembly 102 rests. The substantial concavity of the base assembly 102 may allow a first fuel source to be contained substantially within the center of the base assembly and substantially within the perimeter or circumference of the tower assembly lower portion 116 near the base of the tower assembly 104. Such a configuration may provide maximum heat generation for the combustion of new fuel sources. In one embodiment, the base assembly 102 may be approximately within the range of 18"-30" in diameter. It is contemplated, however, that base assembly 102 may be formed having any measurements suitable for supporting a corresponding tower assembly 104 as needed.

One embodiment of the base assembly 102 comprises a support assembly such as a plurality of circumferentially spaced legs 106 which extend down from an attachment location disposed on an underside 108 of the base assembly 102. In a preferred embodiment, the base assembly 102 is mounted on three legs 106. Legs 106 may be welded, bolted, screwed or otherwise coupled to the underside of the base assembly 102. A base assembly 102 having a diameter of about 18"-30" may comprise legs 106 formed from material within the range of approximately 1" to 2" in diameter and 12"-16" in length. For instance, legs 106 may be solid steel and approximately 1⅜" in diameter and within the range of approximately 14" in length.

The base assembly 102 may further comprise a plurality of handles 114. In one embodiment, the base assembly 102 is ringed with a plurality of handles 114. Handles 114 may be formed from any durable non-flammable material. In one embodiment, handle assemblies are formed from ⅝" steel rod material. Handles 114 may be coupled to an uppermost portion of the base assembly, and may be graspable with a hand, or any utensil or tool suitable for lifting the base assembly 102.

As mentioned, the fire pit 100 further comprises a tower assembly 104. The tower assembly 104 is suitable for resting on or releasably coupling to a top surface 110 of the base assembly 102. In an additional embodiment, the tower assembly 104 is permanently coupled to the base assembly 102. Tower assembly 104 may be substantially conic, pyramidal or any other three-dimensional shape comprising a wider bottom perimeter or circumference than a top perimeter or circumference. In a preferred embodiment, the ratio of top tower assembly perimeter or circumference to bottom tower assembly perimeter or circumference may be approximately 1:1.5. It is contemplated that in a preferred embodiment, tower assembly 104 may be approximately between 17"-27" in length and any diameter less than the diameter of the base assembly 102. The tower assembly 104 is preferably constructed from at least one plate of durable material. Plate may be pattern cut, rolled, and welded to form a hollow tower. In an additional embodiment, tower assembly 104 is constructed from at least two plates that are pattern cut, rolled, and welded together.

The tower assembly 104 comprises a plurality of longitudinal apertures 122. Longitudinal apertures 122 are disposed along the vertical length of the tower assembly 104. In one embodiment, a topmost region of a longitudinal aperture 122 may be disposed at a position below the upper region 120 of the tower assembly 104. For instance, the upper region 120 of the tower assembly 104 may be the top one to four inches of the tower assembly 104 and may comprise a solid band of material. A lowermost region of a longitudinal aperture 122 may be disposed above a tower assembly lower portion 116. For instance the tower assembly lower portion 116 may be the lower one to six inches of the tower assembly 104, and may comprise a solid strip of material along the bottom for stability. Longitudinal apertures 122 provide an air inlet and outlet, allowing air to enter or exit the interior of the tower assembly 104 in the plurality regions where the longitudinal apertures 122 are disposed. Longitudinal apertures 122 also provide a more efficient burn of the fuel source and provide visual confirmation of the fuel source burning within the interior of the tower assembly 104.

Figures 5A, 5B, 5C:
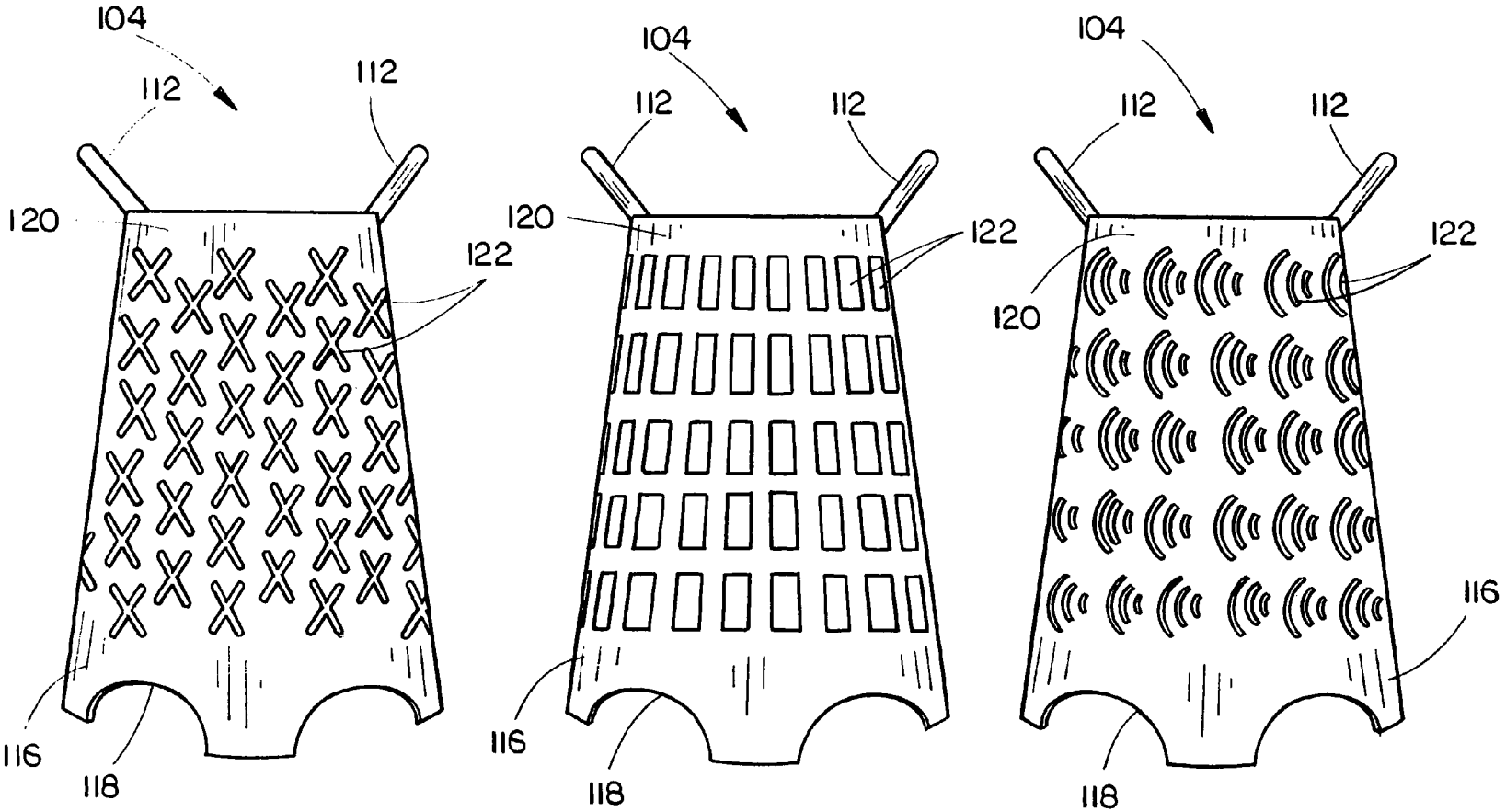
FIGS. 5A-5C are side views of a plurality of tower assemblies suitable for integration with the fire pit base assembly according to the various exemplary embodiments of the present invention.

The longitudinal apertures 122 may be positioned relative to one another and formed having an area suitable for substantially reducing the size of any sparks that might pop, jump, or fly away from the fire. For instance, the longitudinal apertures 122 may be spaced approximately within a range of and ¼" apart and may be approximately ¼" in width at a widest region of the longitudinal aperture 122. It is further contemplated, however, that the longitudinal apertures 122 may be evenly spaced or unevenly spaced. The longitudinal apertures 122 may be disposed substantially about the entire perimeter or circumference of the tower assembly 104, or may be locally disposed in one or more regions of the tower assembly 104. For instance, it is contemplated that fire pit 100 or tower assembly 104 may be positioned against a wall or in a corner. Therefore, it may be desirable to utilize a tower assembly 104 comprising longitudinal apertures 122 disposed on substantially half, two-thirds or the like of the tower assembly 104. The longitudinal apertures 122 are either laser cut or punched with a hydraulic press to give a neat and clean appearance of precision adding to the overall aesthetic appearance. Referring to FIGS. 5A-5C further additional examples of a tower assembly comprising longitudinal apertures 122 are shown. As depicted, longitudinal apertures 122 may be one continuous shape, such as rectangle, a wave, or any other continuous shape, or may be a continuous series of one or more shapes, designs or patterns such as diamonds, triangles flames, rectangles, squares, or any other shape, pattern or design, including any random or nonrandom combination of shape, pattern and design.

A tower assembly lower portion 116 may be formed with a plurality of openings or cut out portions 118. Cut out portions 118 are configured such that less than the entire perimeter or circumference of the tower assembly lower portion 116 contacts the top surface 110 of the base assembly 102. In one embodiment, cut out portions 118 are semi-circular cut out portions, however, cut out portions may be any shape, including, but not limited to, rectangular, triangular, trapezoidal, or may be any pattern or design, including a custom design in accordance with the desires of a user. The remaining material of the tower assembly lower portion 116 forms support mechanisms for the tower assembly 104 when the tower assembly is disposed on the top surface 110 of the base assembly 102 or on any other surface. Cut out portions 118 also allow insertion and/or ignition of lighting fluid, kindling, wood, coal, devolatilized coal or any other fuel source into the lower region of the tower assembly 104 without requiring a user to drop the fuel source or attempt to ignite it from the top of the tower assembly 104. Cut out portions 118 also allow for a solid fuel source spread out into the base assembly 102 as the fire grows, further providing increased more space inside the tower assembly 104 for additional fuel sources.

A fuel source may be inserted into the tower assembly 104 via the open top region 124 or through the cut out portions 118 as described previously. Open top region 124 may further allow the escape of generated heat from a fuel source. Open top region 124 may also be fitted with a lid or protective cover such as a perforated lid to further inhibit the escape of burning embers or other smaller portions of a fuel source as the fuel source burns.

Tower assembly 104 is designed to contain a fuel supply substantially within and above a central region of the base assembly 102. Tower assembly 104 allows heat generated from a fuel supply to radiate substantially outwardly along a vertical axis. Tower assembly 102 allows a first fuel supply such as wood to be positioned over a second fuel supply such as coal, or subsequent additions of fuel above the burning embers of previous fuels, that is positioned within the interior of the tower assembly 104 in a bottom region of the tower assembly 104 corresponding with a central region of the base assembly 102. Tower assembly configuration focuses combustion in a generally upward direction throughout substantially the vertical length of tower assembly 104 and above the central portion of base assembly 102. Such configuration increases combustion along substantially the entire vertical length of the tower assembly 104, in a substantially outward direction along substantially the entire length of the plurality of longitudinal apertures 122 above the coal bed, allowing for greater vertical radiation of heat. In this manner, the critical mass or greatest concentration of combustion activity of the generated fire is located substantially above the lowest point of the base assembly 102. This elevated positioning of the critical mass of the fire allows a greater amount of heat to exit the tower assembly 104 through the longitudinal apertures 122.

The tower assembly 104 comprises at least one handle 112 similar to handles 114 of the base assembly 102. In a preferred embodiment, the tower assembly 104 comprises two handles 112. Handle 112 may be formed from any durable non-flammable material. In one embodiment, handle 112 may be formed from substantially rod shaped steel or other durable metal, such as approximately ⅜" steel rod material. Handle 112 may be coupled to an uppermost portion of the tower assembly 104, and may be graspable with a hand, or any utensil or tool suitable for lifting the tower assembly 104.

The base assembly 102 and tower assembly 104, legs 106 and handles 112, 114 may be formed from any durable non-flammable material. For instance, any alloy metal such as steel or stainless steel, aluminum or other alloys suitable for use in high temperature fire pit heating and cooking apparatuses may be utilized. It is contemplated, however, that any non-flammable material of any thickness may be utilized to form fire pit components as desired, and any other materials known in the art of fire pits are contemplated. In the preferred embodiments, fire pit components are constructed from any type of steel. In one embodiment, base assembly 102 and tower assembly are constructed from at least ¼" steel but may be constructed from material within a thickness range of about ⅛" to ¾".

Figure 6:
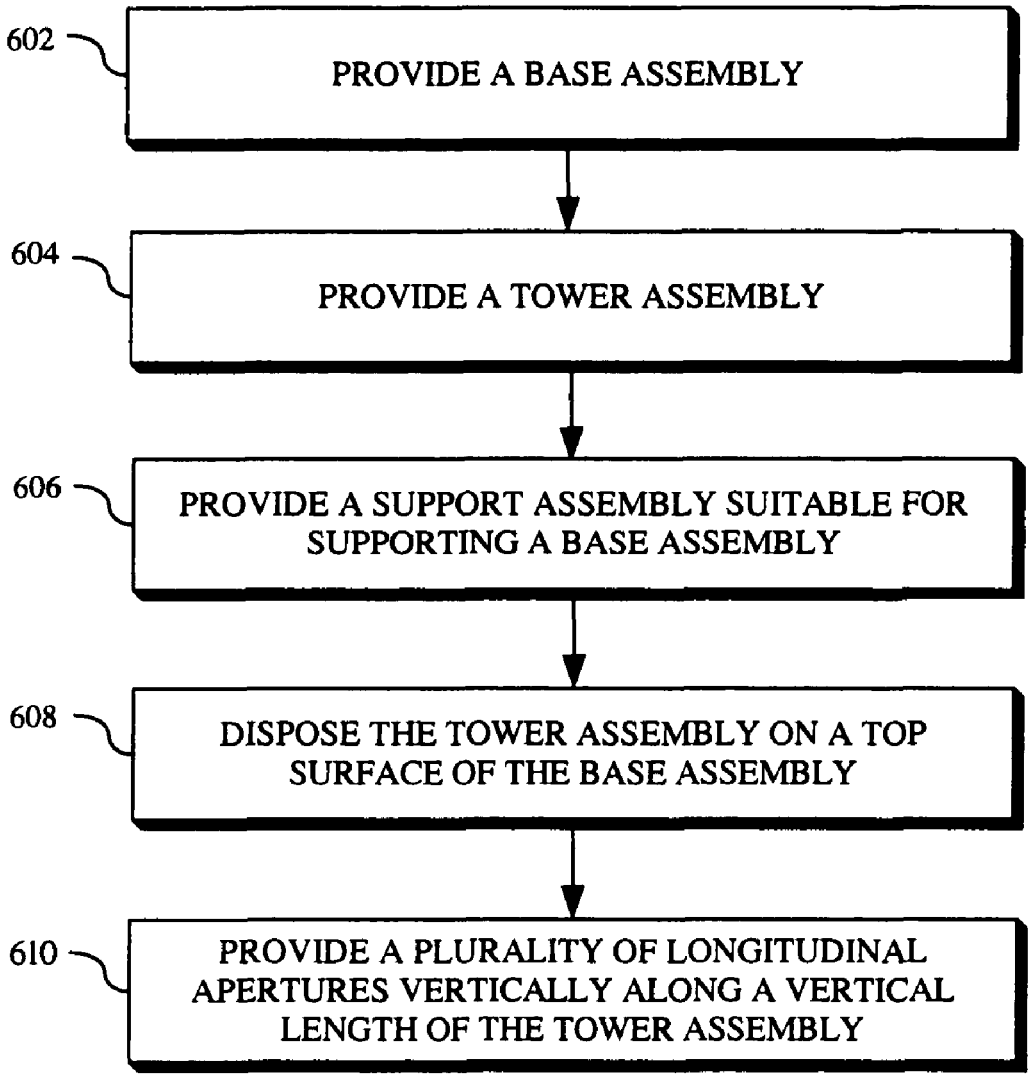
FIG. 6 is a flow diagram depicting a method for manufacturing a fire pit according to the various exemplary embodiments of the present invention.

Referring to FIG. 6, a flow diagram depicting a method 600 for manufacturing a fire pit according to the various exemplary embodiments of the present invention is shown. Method 600 comprises providing a base assembly 602, and providing a tower assembly 604. Base assembly and tower assembly may be configured as described above and in FIGS. 1-5C. Method 600 further comprises providing a support assembly suitable for supporting the base assembly 606. In one embodiment, support assembly comprises a plurality of legs, as described above and in FIGS. 1-4. Method 600 may dispose the tower assembly on a top surface of the base assembly 608. Method 600 further comprises providing a plurality of longitudinal apertures vertically along a vertical length of the tower assembly 610. Longitudinal apertures may be formed as described above and in FIGS. 1-5C. Method 600 may configure tower assembly to contain at least one solid fuel source and release heat generated from the solid fuel source in a substantially outward direction along substantially the entire length of the plurality of longitudinal apertures.

It is understood that the specific order or hierarchy of steps in the foregoing disclosed method are examples of exemplary approaches. Based upon design preferences, it is understood that the specific order or hierarchy of steps in the method may be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in size, materials, shape, form, function, manner of operation, assembly and use of the components thereof without departing from the scope and spirit of the invention or without sacrificing all of its material advantages. The form herein before described being merely an explanatory embodiment thereof. Further, it is contemplated that the specific order or hierarchy of steps in the method can be rearranged while remaining within the scope and spirit of the present invention. It is the intention of the following claims to encompass and include such changes.

What is claimed is:

1. A fire pit comprising:

a base assembly, said base assembly includes a central region and edge region, the central region lower with respect to a vertical axis than the edge region, the edge region surrounds the central region, said base assembly supported by a support assembly comprising a plurality of vertical supports, the plurality of vertical supports coupled to a bottom side of the base assembly; and a tower assembly releasably placed on a top surface of said base assembly, said tower assembly configured to contain at least one solid fuel source in a substantially vertical orientation, said tower assembly including:

an upper region formed from a durable non-flammable material, said upper region including a solid band of material;

a substantially central region formed from said non-flammable material, and including a plurality of longitudinal apertures and configured to contain at least one fuel source, said longitudinal apertures run along a vertical length of said tower assembly; and a lower region formed of said durable non-flammable material, said lower region including a solid band of material, wherein each of said plurality of longitudinal apertures is configured to release heat generated from said at least one solid fuel source in a substantially outward direction along at least substantially an entire length of said plurality of longitudinal apertures, said tower assembly is substantially conic or pyramidal, said lower region of said tower assembly includes a plurality of cut out regions and a plurality of support regions, said plurality of support regions configured for support on said top surface of said base assembly and said plurality of cutout regions configured for release of residual burned fuel source out of said tower assembly, said tower assembly includes a top side aperture and a bottom side aperture, said top side aperture of said tower assembly is configured for receipt of said at least one fuel source.

2. The fire pit of claim 1, wherein said base assembly further comprises a plurality of handles.

3. The fire pit of claim 1, wherein said tower assembly further comprises at least one handle.

4. The fire pit of claim 1, wherein said solid fuel source is at least one of coal, wood or paper.

5. The fire pit of claim 1, wherein said plurality of longitudinal apertures are formed from at least one of manual cutting, saw cutting, grinding, torch cutting, laser cutting or hydraulic press punching.

6. The fire pit of claim 1, wherein said plurality of longitudinal apertures are each one continuous shape, a continuous series of one or more shapes, designs or patterns, a random combination of one or more shapes, designs or patterns, or a non random combination of one or more shapes, designs or patterns.

7. The fire pit of claim 1, wherein said base assembly and said tower assembly are formed from a material having a thickness range of about ⅛ inch to ¾ inch.

8. The fire pit of claim 1, wherein said plurality of longitudinal apertures are located within one-half of the tower assembly.

9. The fire pit of claim 1, wherein a ratio of a perimeter of the top side aperture of said tower assembly to a perimeter of the bottom side aperture of said tower assembly is 1:1.5.

10. The fire pit of claim 1, wherein said solid band of material of said lower region and said upper region is one to six inches in length.

11. The fire pit of claim 1, wherein said base assembly being a substantially concave dish.

12. A fire pit comprising:

a base assembly, the base assembly supported by a support assembly comprising a plurality of vertical supports; and a tower assembly supported by the base assembly, the tower assembly having a truncated cone shape maintaining at least one solid fuel source in a substantially vertical orientation to allow the at least one solid fuel source to be burned more thoroughly and vigorously to promote more heat to be radiated along a full length of the tower assembly, the tower assembly further comprising:

a plurality of longitudinal apertures, the apertures running along a vertical length of the tower assembly;

an upper region; and a lower portion wherein the lower portion of the tower assembly has a wider diameter than the upper region of the tower assembly to assist in maintaining the at least one solid fuel source in the substantially vertical orientation to permit heat to emit from the apertures of the tower assembly, the lower portion of the tower assembly includes a plurality of cutout regions configured for release of residue into the base assembly from burning the at least one solid fuel source.

13. A fire pit comprising:

a base assembly, the base assembly supported by a support assembly comprising a plurality of vertical supports; and a tower assembly supported by the base assembly, the tower assembly having a truncated pyramid shape maintaining at least one solid fuel source in a substantially vertical orientation to allow the at least one solid fuel source to be burned more thoroughly and vigorously to promote more heat to be radiated along a full length of the tower assembly, the tower assembly further comprising:

a plurality of longitudinal apertures, the apertures running along a vertical length of the tower assembly;

an upper region;

a top side aperture;

a bottom side aperture; and a lower portion wherein the lower portion of the tower assembly has a wider bottom side aperture than the top side aperture of the tower assembly to assist in maintaining the at least one solid fuel source in the substantially vertical orientation to permit heat to emit from the apertures of the tower assembly, the lower portion of the tower assembly includes a plurality of cutout regions configured for release of residue into the base assembly from burning the at least one solid fuel source.

* * * * *